US011833091B2

(12) United States Patent
Vrzalik et al.

(10) Patent No.: US 11,833,091 B2
(45) Date of Patent: Dec. 5, 2023

(54) MOISTURE CONTROL COVERLET

(71) Applicant: Arjo IP Holding AB, Malmo (SE)

(72) Inventors: John H. Vrzalik, San Antonio, TX (US); Mathew Pickering, San Antonio, TX (US); Kz Hong, San Antonio, TX (US); Matthew Cavanaugh, San Antonio, TX (US)

(73) Assignee: Arjo IP Holding AB, Malmo (SE)

( * ) Notice: Subject to any disclaimer, the term of this patent is extended or adjusted under 35 U.S.C. 154(b) by 405 days.

(21) Appl. No.: 15/529,209

(22) PCT Filed: Nov. 24, 2015

(86) PCT No.: PCT/US2015/062549
§ 371 (c)(1),
(2) Date: May 24, 2017

(87) PCT Pub. No.: WO2016/086073
PCT Pub. Date: Jun. 2, 2016

(65) Prior Publication Data

US 2017/0354558 A1 Dec. 14, 2017

Related U.S. Application Data

(60) Provisional application No. 62/083,433, filed on Nov. 24, 2014.

(51) Int. Cl.
*A61G 7/057* (2006.01)

(52) U.S. Cl.
CPC ..... *A61G 7/05792* (2016.11); *A61G 7/057* (2013.01); *A61G 2210/70* (2013.01)

(58) Field of Classification Search
CPC ..... A61G 7/05792; A61G 7/057; A61G 2210/70; F04B 33/005; F04B 39/123;
(Continued)

(56) References Cited

U.S. PATENT DOCUMENTS 5,267,363 A * 12/1993 Chaffee ..... F16K 15/148 5/713
5,584,084 A * 12/1996 Klearman ..... A61G 7/05769 403/2

(Continued)

FOREIGN PATENT DOCUMENTS

CN 201588758 U 9/2010
WO WO-2005000074 A1 * 1/2005 ..... A47C 27/082
WO 2013111021 A2 8/2013

OTHER PUBLICATIONS

Intex Marketing Ltd., AP619RL Remote Control Built-In Electric Pump, 2011, pp. 1-4.*

*Primary Examiner* — Justin C Mikowski
*Assistant Examiner* — Amanda L Bailey
(74) *Attorney, Agent, or Firm* — THE WEBB LAW FIRM

(57) ABSTRACT

A moisture control coverlet (10) includes a fluid pathway for moisture removal fluid It is selectively configurable to use a first fluid pump (32), and/or an adaptor (34). The first fluid pump (32) can be mounted on the coverlet and coupled to the fluid pathway for pumping moisture removal fluid into or out of the fluid pathway. The adaptor (34) can be mounted on the coverlet and coupled to the fluid pathway and can be coupled to a second fluid pump (48) for pumping moisture removal fluid into or out of the fluid pathway.

19 Claims, 6 Drawing Sheets

(58) Field of Classification Search
CPC ..... F04B 39/16; F04B 39/12; F04B 39/121; F04B 39/14; F04B 53/16; F04B 53/22; F04D 29/441; F04D 29/4226; F04D 29/60; F04D 29/646; F04D 29/626; F04D 29/40; F04D 29/406; F04D 29/605; F04C 2240/30; F24H 9/0073; F24H 9/0078
See application file for complete search history.

(56) References Cited

U.S. PATENT DOCUMENTS 5,890,882 A * 4/1999 Feldman ..... F04D 25/084 417/411
6,332,760 B1 * 12/2001 Chung ..... F04D 25/084 417/239
6,483,264 B1 * 11/2002 Shafer ..... F04D 27/004 318/16
6,782,574 B2 * 8/2004 Totton ..... A61G 7/05769 5/710
8,372,182 B2 2/2013 Vrzalik et al.
8,641,391 B2 * 2/2014 Pan ..... F04D 25/0673 417/305
8,918,930 B2 12/2014 Stroh et al.
10,443,602 B2 * 10/2019 Liu ..... F04D 25/084
2007/0261548 A1 * 11/2007 Vrzalik ..... A47C 21/044 95/52
2008/0244834 A1 * 10/2008 McClintock ..... A47C 27/082 5/694
2008/0263776 A1 * 10/2008 O'Reagan ..... A61G 7/05746 5/714
2011/0247143 A1 * 10/2011 Richards ..... A47C 27/005 5/713
2012/0167303 A1 * 7/2012 Stroh ..... F04D 25/084 415/182.1
2013/0025053 A1 * 1/2013 Vrzalik ..... A61G 7/057 5/495
2013/0172802 A1 * 7/2013 Cavanaugh ..... A61G 7/057 602/46
2014/0112812 A1 * 4/2014 Takemi ..... F04B 39/121 417/571
2016/0123349 A1 * 5/2016 Wang ..... F04D 29/4226 415/175

* cited by examiner

MOISTURE CONTROL COVERLET

CROSS-REFERENCE TO RELATED APPLICATIONS

This application is the United States national phase of International Application N. PCT/US2015/062549 filed Nov. 24, 2015, and claims priority to U.S. Provisional Patent Application No. 62/083,433, filed Nov. 24, 2014, the disclosures of which are hereby incorporated in their entirety by reference.

FIELD OF THE DISCLOSURE

The present disclosure relates to moisture control coverlets and kits therefor.

BACKGROUND

There exist patient support systems that aid in the prevention of decubitus ulcer formation and/or promote the healing of decubitus ulcers for a patient lying on a bed. Such support systems can also aid in the removal of moisture, vapor and heat adjacent to a patient. Often, however, such systems do not have modular connections to various forms of fluid pumps and power sources. Additionally, these devices may not be easily used on surfaces other than beds. As such, there is a need to develop modular patient support systems to facilitate the prevention of decubitus ulcers as well as promote the healing of decubitus ulcers that may be used in variety of different environmental settings.

SUMMARY

Embodiments of the present disclosure relate to an improved moisture control coverlet, kit, system and method.

According to an exemplary embodiment of the present disclosure, there is provided a moisture control coverlet including a fluid pathway for moisture removal fluid, wherein for pumping moisture removal fluid into or out of the fluid pathway, the moisture control coverlet is: selectively configurable to use a fluid pump mounted on the moisture control coverlet; and selectively configurable to use an adaptor mounted on the moisture control coverlet and coupled to a remote fluid pump.

According to another exemplary embodiment of the present disclosure, there is moisture control coverlet including: a fluid pathway, wherein moisture removal fluid is pumped into or out of the fluid pathway for removing moisture from a surface of the moisture control coverlet; and a mounting element in fluid communication with the fluid pathway, the mounting element selectively configured to be mounted to a fluid pump and selectively configured to be mounted to an adaptor capable of being coupled to a remotely positioned fluid pump.

In another exemplary embodiment of the present disclosure, there is a moisture control coverlet including: a fluid pathway, wherein moisture removal fluid is pumped into or out of the fluid pathway for removing moisture from a surface of the moisture control coverlet; and an adaptor removably mounted to the moisture control coverlet and in fluid communication with the fluid pathway, wherein the adaptor is selectively configurable to be coupled to a remote fluid pump.

According to an exemplary embodiment of the present disclosure there is provided a kit including: the coverlet; a first fluid pump for mounting onto the coverlet; and an adaptor for mounting onto the coverlet; the adaptor being for coupling to a remote fluid pump.

Embodiments of the present disclosure may enable a selection to be made as to whether to use a first pump, which can be relatively small and low power, or an adaptor coupled to a second pump, which is generally external and able to be more powerful. This provides interchangeable air supplies which in some embodiments allows portable use with small air supplies, yet can utilize larger, more powerful and more featured air supplies for non-portable, sleep, and other applications. The selection can also enable different levels of therapy to be selected.

Furthermore, since in example embodiments the second pump can be selectively attached to and detached from the adaptor, the coverlet can be transported as a single unitary item without the external air supply, attachment tubes and such external features that make many prior art systems cumbersome.

In other words, the coverlet may be configured to use either a local fluid pump on the coverlet or a remote fluid pump coupled via an adaptor. The local or remote fluid pumps can be used for example at the same or different times.

In some embodiments, the coverlet includes a mounting element in fluid communication with the fluid pathway for having mounted on it a first fluid pump or an adaptor for a remote second fluid pump. The first fluid pump and the adaptor can each include a coupling element configured to couple with the mounting element on the coverlet in order to selectively mount either the first fluid pump or the adaptor on the mounting element. In embodiments, the first fluid pump and the adaptor can be removably mounted on the mounting element so they can for example be mounted at different times, such as consecutively.

In other embodiments, the coverlet includes a first mounting point in fluid communication with the fluid pathway for mounting a fluid pump, and a second mounting point in fluid communication with the fluid pathway for mounting an adaptor for coupling to a remote fluid pump. Each of the first and second mounting points can include a mounting element as described above. The first fluid pump can include a coupling element configured to couple with the first mounting element and the adaptor can include a coupling element configured to couple with the second mounting element. In some embodiments, the first fluid pump and the adaptor each include a coupling element configured to couple with either the first or second mounting elements. In such embodiments, the first fluid pump and the adaptor can be removably mounted on their respective mounting elements, or in some embodiments on either mounting element.

According to one embodiment of the present disclosure, there is provided a moisture control coverlet, including: a fluid pathway for moisture removal fluid; a first fluid pump coupled to the fluid pathway for pumping moisture removal fluid into or out of the fluid pathway; and an adaptor coupled to the fluid pathway, the adaptor being for coupling the fluid pathway to a second fluid pump.

In some embodiments, the first pump may be configured to be battery powered, for example by including a battery coupler for coupling to a battery, meaning that a bulky power adaptor does not need to be transported with the system and also meaning that the system can be set up and operated in the absence of an external power supply. It can therefore help cancer patients be more comfortable while receiving treatment while also protecting skin that could become compromised.

In some embodiments, the first pump includes a battery.

In some embodiments, the first pump can be configured to be powered by an AC power supply, for example, by including an AC coupler for coupling to an AC power supply.

Where the first pump includes a battery coupler and an AC coupler, it may be selectively powered by either a battery or an AC power supply.

According to another embodiment of the present disclosure, there is provided a moisture control coverlet including a fluid pathway for moisture removal fluid and a pump system for pumping moisture removal fluid into or out of the fluid pathway, wherein the coverlet is configured for placement over a chair.

The pump system may be configured to be powered by a battery and/or can be configured to be powered by an AC power supply for example by including a battery coupler for coupling to a battery and/or by including an AC coupler for coupling to an AC power supply.

According to another embodiment of the present disclosure, there is provided a moisture control coverlet including a fluid pathway for moisture removal fluid and a pump system for pumping moisture removal fluid into or out of the fluid pathway, wherein the pump system is selectively configurable to be powered by an AC power supply and is selectively configurable to be powered by a battery.

According to another embodiment of the present disclosure, there is provided a moisture control coverlet including a fluid pathway for moisture removal fluid and a pump system for pumping moisture removal fluid into or out of the fluid pathway, the pump system including a battery coupler for coupling to a battery and an AC (i.e., alternating current) coupler for coupling to an AC power supply, to enable the pump system to be selectively powered by a battery and/or an AC power supply.

Where the pump system can be selectively configured to be powered by an AC power supply and selectively configured to be powered by a battery, the user is able to make a choice as to whether the pump system is to be powered by an AC power supply or a battery. This means that the pump system can operate with a greater power where there is the option of plugging the pump system into a wall socket, for example, but the pump system is still able to be used where there is not such access to AC power. This can enable the same pump system to be used in a location where the coverlet is to be set up to allow a patient to remain for some time, such as in a hospital, as well as being used in more temporary locations, such as while travelling or waiting for a short period, when it is not possible or convenient to utilize an AC power outlet. The selection of power supply can also enable different levels of therapy to be conveniently applied to a patient using the coverlet.

The coverlet may include first, second and third layers, wherein the second layer provides the fluid pathway and is sandwiched between the first and third layers, wherein at least one of the first and third layers provides a bacterial barrier.

According to an exemplary embodiment of the present disclosure, there is provided a moisture control coverlet including first, second and third layers, wherein the second layer provides a fluid pathway for moisture removal fluid and is sandwiched between the first and third layers, wherein at least one of the first and third layers provides a bacterial barrier.

In some embodiments, the first and third layers provide bacterial barriers. In some embodiments, at least one of, preferably both of, the first and third layers provide viral barriers, for example by being air impermeable.

There can be provided a pump system for coupling to the second layer, for example via an aperture in the first and/or third layer, for pumping moisture removal fluid into or out of the second layer.

Infection control and prevention of cross contamination is a high priority for certain classes of patients, especially in hospitals and in chemo and dialysis centers, and embodiments of the present disclosure are able to limit or prevent cross-contamination.

Furthermore, often, in chemo and dialysis centers, a patient is seated for treatment. In these and in other seating applications, embodiments of the present disclosure can be placed onto a chair to isolate a person from contamination from the seating. Other seating applications can include public transportation, such as planes, trains and buses, or seating in public places such as in movie theaters and the like. In addition to removing moisture and cooling a patient or person, embodiments of the present disclosure when placed on a chair can help isolate a patient or person from any contamination that may exist in a seating device being used. In embodiments of the present disclosure, the bacterial barrier exists even if a pump system for the coverlet is not attached or is not powered. This is especially beneficial if the person already has a compromised immune system.

Embodiments are therefore advantageous in minimizing cross contamination.

In example embodiments, the coverlet is configured for placement over a chair.

The pump system can include the first pump described herein. In some embodiments the only pump in the pump system is the first fluid pump, which in some embodiments includes a single fan.

The pump system can include a pump on the coverlet or for mounting directly on the coverlet.

The pump system can include a pump remote from the coverlet and coupled or for coupling to the fluid pathway for example via an adaptor as described herein.

Existing patient support systems are not suitable for all classes of patients. There is a variety of patients (e.g., Chemotherapy, Cancer, Dialysis and others) that can greatly benefit from a microclimate management device but are not, or should not be, constantly lying down. Furthermore, the level of required therapy varies greatly from patient to patient and even varies with the same patient at different times.

Chemotherapy patients often sit for long periods of time while receiving treatment. The drugs used often cause patients to sweat and cause their temperatures to rise and fall. Existing systems cannot fit on the recliners normally used in chemo clinics and are too cumbersome for patients to transport.

A coverlet, otherwise referred to herein as a device, that can selectively be powered by either an external power supply, such as a 120 V AC wall plug, or by a battery pack for example when used in a portable application, and/or have interchangeable air supplies for producing different levels of required therapy is beneficial to the patient.

In some embodiments, the first pump is configured to be battery powered and the second pump is configured to be powered by an AC power supply.

The coverlet typically has a vapor permeable surface allowing for vapor to permeate from an external vicinity of the vapor permeable surface to the fluid pathway. The vapor permeable surface is for being placed adjacent to a patient.

Example embodiments provide a moisture removal and cooling device that may have interchangeable air supplies for cancer/chemotherapy and other patients.

Example embodiments of the device can be used on chairs as well as support surfaces such as beds.

In one embodiment, the moisture control coverlet may include: a first layer on which a patient may be supported; a second layer including a fluid pathway, wherein moisture removal fluid is pumped into or out of the fluid pathway for removing moisture from a surface of the first layer of the moisture control coverlet; and at least one coverlet connector for removably attaching the coverlet to a chair.

Example embodiments can roll up like a sleeping bag to be taken to other therapy locations, such as Chemotherapy and Dialysis.

Example embodiments can be launderable (e.g., machine washable) for cleaning, and the pumps or air supplies and/or the adaptor can be removable for this type of cleaning.

Embodiments of the device can use a small pump or air supply with limited air volume for portable applications and the system can include a larger, more featured pump or air supply for more permanent use on a support surface such as a bed. The more permanent installation can include an air hose attached to the device and coupled to a higher capacity air supply box located, for instance, on the footboard of a bed on which the device is located.

The second pump or air supply can include, but is not limited, to; (i) HEPA filter to trap bacteria and virus, (ii) filter(s) that could be cleaned and replaced, (iii) filtration, such as charcoal, for odor control, (iv) UV light, or chemical killing of bacteria, (v) variable air flow delivery on demand to customize performance for a specific patient or different performance requirements for the same patient at different times, (vi) reusable box with disposable or launderable device to reduce costs, (vii) reusable box with or for use with disposable device, disposable adapter, conduit, and filter so that reusable box less filter can be used with multiple disposable devices, adapters, conduits and filters where contaminated items can be disposed of and only reusable box is reused multiple times with the same or another patient, and (viii) any permutation of the foregoing. In a suction application, in other words one that uses negative pressure, this makes everything disposable that is exposed to contaminated air from the coverlet, conduit and filter. The filter with associated cover and conduit are disengageable from the reusable box, leaving a "clean" box onto which another coverlet conduit and filter can be installed for use with the same or another patient.

Embodiments of the present disclosure allow for portable use of a Skin IQ™-like product to control the microclimate of a patient in non-lying support applications, for example, during required therapy treatments where lying supine is not possible. Embodiments allow for use of a disposable device with a removable and interchangeable air supply that does not have to be disposed of with the device. Embodiments allow for the use of a launderable device with an air supply that can be removed, cleaned, and reused multiple times with the same or another device and with the same or another patient Embodiments can be used on any chair or surface. Exemplary embodiments are flat (without elastic corners) so that they can be used on chairs, and mattresses alike.

The coverlet may include straps or ties for securing it to the seating device.

Example embodiments are roll-able (like a sleeping bag) so patients can for example take it with them for chemotherapy treatment (often lasting more than four hours in chair/recliners—not beds) while also using it at home.

Embodiments can be fitted with a plug, for example a 120 volt two or three prong wall plug, for providing power to the first pump while at home but can offer a battery source that lasts 4-5 hours for powering the first pump while in a chemotherapy clinic.

Embodiments can be washable and durable.

Embodiments can be used on almost any hospital surface, including exam tables, wheelchairs, and beds. Embodiments can be used for patients when travelling, used in car seats or while on planes or in hotels.

The first air supply or pump and/or adaptor can be integral and disposable with device. In other embodiments, the first air supply or pump and/or the adaptor can be removable for example for cleaning, such as laundering the device.

The first air supply or pump can be removable and cleaned especially if the device is disposable.

The first air supply or pump can include an integrated fan.

The second air supply or pump can be provided with additional features and can be remote and connected to the device with a hose or other conveyance means for transferring air to, or from, the device.

Embodiments of this present disclosure allow the use of multiple air supplies for powering a microclimate managing device. For many patients, the level of therapy provided by an integrated, disposable air supply is adequate. For more severe cases, greater moisture removal and temperature reduction is desirable and this can be provided by an external pump coupled to the adaptor.

Sometimes, the patient's condition changes, requiring different levels of therapy. Embodiments of the present disclosure include a plurality of air supplies that are interchangeable to provide different levels of therapy at different costs. The integrated fan and device provide the greatest continence with moderate performance. If needed, a remote air supply can be used instead, coupled to the adaptor by a hose to deliver higher levels of therapy. The remote air supply can be supported on a bed footboard, or any other convenient location.

According to an embodiment of the present disclosure, there is provided a method of operating a moisture control coverlet, the moisture control coverlet includes a fluid pathway for moisture removal fluid, the method including operating a pump system to pump moisture removal fluid into and/or out of the fluid pathway.

The coverlet and the pump system can be as described elsewhere herein.

Operating the pump system can include operating a first fluid pump on the coverlet for a first period of time and operating a second fluid pump coupled to an adaptor for a second period of time, the adaptor being on the coverlet. The first and second periods of time can be the same, different or overlapping. The first and second periods of time can be consecutive.

Operating the pump system can include mounting a first fluid pump on the coverlet and/or can include coupling a remote second fluid pump to the coverlet.

Coupling the remote second fluid pump to the coverlet can include mounting an adaptor on the coverlet, the adaptor being for coupling to the second fluid pump. Coupling the remote second fluid pump can include coupling the second fluid pump to the adaptor.

Mounting the adaptor on the coverlet can include dismounting the first fluid pump from the adaptor and/or mounting the first fluid pump on the coverlet can include dismounting the adaptor from the coverlet.

Operating a pump system can include operating the pump system using battery power for a first period of time and operating the pump system using AC power for a second period of time. The first and second periods of time can be the same, different or overlapping. The first and second periods of time can be consecutive.

The method can include removing the first fluid pump and/or the second fluid pump and/or the adaptor from the coverlet for transporting the coverlet.

According to an exemplary embodiment of the present disclosure, there is provided a moisture control coverlet including a fluid pathway for moisture removal fluid and a switching element for switching between a first pump for pumping moisture removal fluid into or out of the fluid pathway and a second pump for pumping moisture removal fluid into or out of the fluid pathway.

The switching element can include the mounting element described elsewhere herein.

In some embodiments, the switching element can include an operating switch for the first fluid pump as described elsewhere herein.

BRIEF DESCRIPTION OF THE DRAWINGS

Embodiments of the present disclosure are described below, by way of example only, with reference to the accompanying drawings, in which.

DETAILED DESCRIPTION OF DISCLOSED EMBODIMENTS

Figure 1:
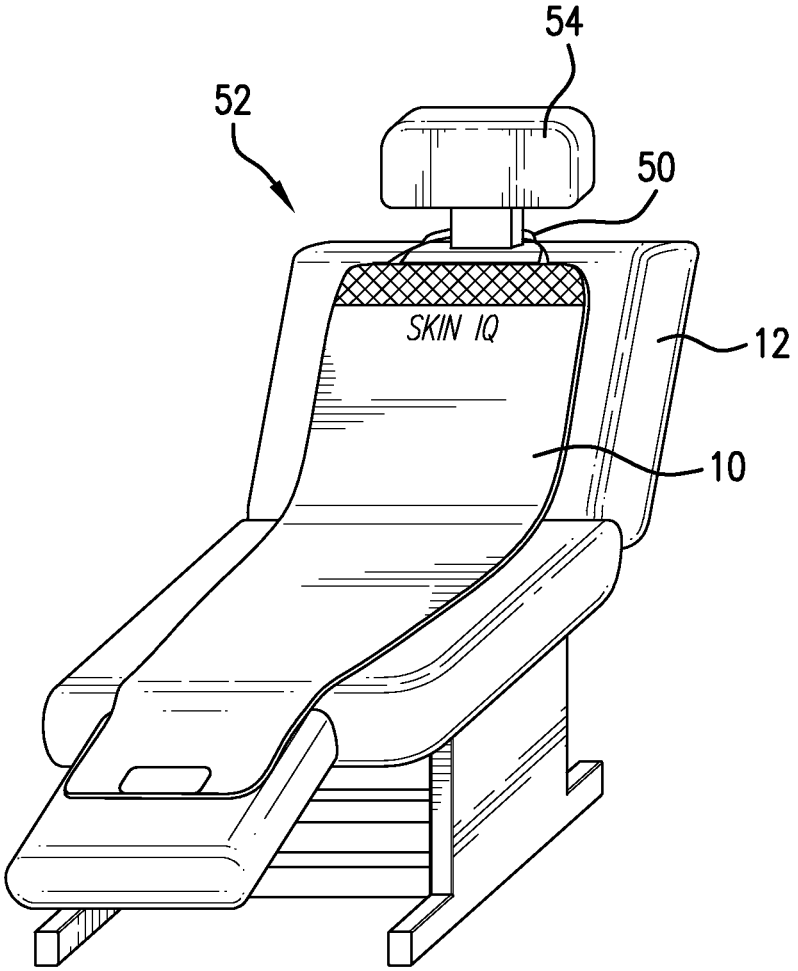
FIG. 1 is a schematic diagram of a coverlet according to an example embodiment of the present disclosure on a chair.

FIG. 1 shows a moisture control coverlet 10 in accordance with an embodiment of the present disclosure attached to a chair 12.

Figure 3A:
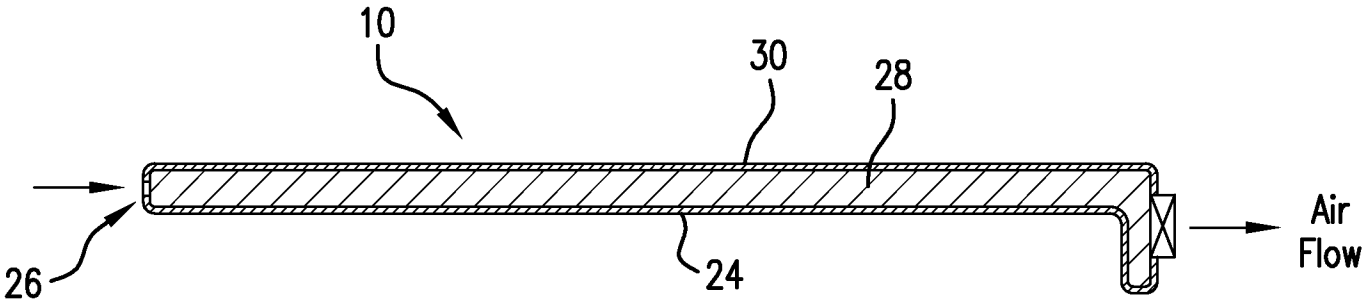
FIGS. 3A and 3B are schematic cross-sectional views of the coverlet of FIGS. 1 and 2 showing different modes of operation.

As can be seen in FIGS. 3A and B, the coverlet 10 includes a pump system 18.

As shown in FIG. 3A, this embodiment includes three layers, a first layer 30, second layer 28 and third layer 24. The first layer 30 is vapor permeable, liquid impermeable, and either air permeable or impermeable. The second layer 28 is a spacer material that allows air to flow through it under negative pressure or positive pressure. The second layer 28 separates the first layer 30 and the third layer 24. A spacer material refers to any material that includes a volume of air within the material and allows air to move through the material. The third layer 24 comprises a material that is vapor impermeable, air impermeable and liquid impermeable.

The first and third layers provide bacterial barriers. Furthermore, by being air impermeable, the first and third layers can also be viral barriers.

The first layer 30 and the third layer 24 are connected at a permeable interface 26.

The spacer material 28 provides a fluid pathway through which moisture removal fluid, in this embodiment air, can flow.

The pump system 18 is coupled in fluid communication with the spacer material of the second layer 28. The pump system 18 is operable to pump air into the second layer 28 or to pump air out of the second layer 28.

The interface 26 is highly air permeable to allow the air flow created by pump system 18 to flow in either direction essentially unrestricted. Interface 26 exists only at an end of coverlet 10 opposite an end where pump system 18 is coupled to the coverlet, so that air can flow from pump system 18 through second layer 28 and exit interface 26; or air can flow into interface 26 through second layer 28 and out pump system 18. The edges of the first and third layers are joined in a non-permeable manner except for at the interface 26.

Figure 3B:
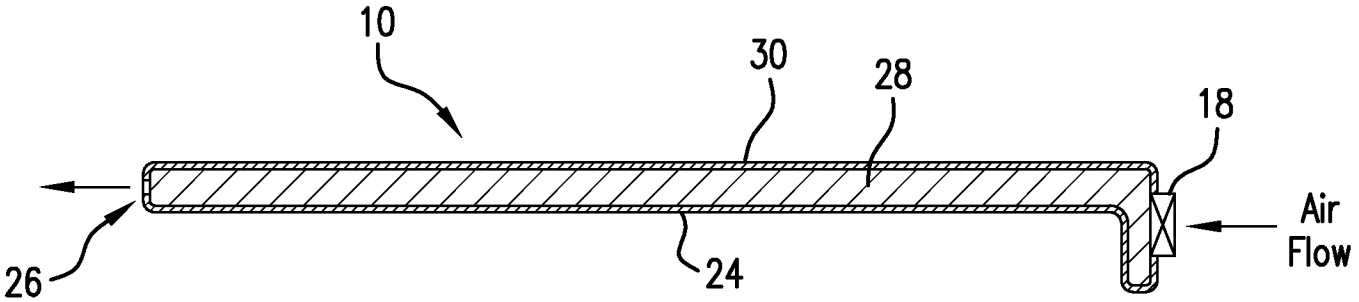

FIG. 3A shows negative pressure flow within the second layer 28 with air flow from interface 26 to and through pump system 18. FIG. 3B shows positive pressure flow within second layer 28 with air flow from pump system 18 through second layer 28 and out interface 26.

When a patient is placed on the first layer 30 and perspires, this will cause air adjacent to the first layer 30 to have a high relative humidity. When air in the spacer material 28 has a lower relative humidity, vapor will permeate through the cover sheet 30 from the patient to the air in the spacer material 28.

Air can flow into and/or out of the spacer material 28 in some embodiments directly through the first layer 30.

This means that as moisture transfers through the first layer 30 from a patient adjacent to the first layer 30, and raises the relative humidity of the air in the spacer material 28, that air is replaced as a result of operation of the pump system 18. This ensures that the air adjacent the first layer 30 is kept at a low relative humidity and the moisture transfer rate from a patient can be maintained.

The pump system 18 is shown more clearly in FIGS. 3C, 4, 5 and 6. In one embodiment, the pump system includes a first pump 32 and an adaptor 34. The first pump 32 and the adaptor 34 are provided side-by-side at a surface of the coverlet 10 preferably at the end opposite the interface 26 such as a foot of the coverlet 10, and coupled in fluid communication with the fluid pathway.

The coverlet 10 can be provided with a first aperture in the surface of the coverlet 10, thereby exposing the fluid pathway.

The first pump 32 is coupled to the first aperture to enable the first pump 32 to pump air into and/or out of the first aperture. In order to do this, the first pump 32 is operable to provide a negative or a positive pressure to the fluid pathway for example using an integrated fan. The first pump 32 is removably mounted on and coupled to the surface of coverlet 10, in this embodiment by a plurality of fasteners such as screws 36. However, in other embodiments the first pump 32 can be coupled to the coverlet 10 in a removable manner by any other means known to the skilled person. In other embodiments, the first pump can be integral with the coverlet 10.

The first pump can include an operating switch to allow it to be selectively operated.

In a corresponding manner to the aperture for the first pump 32, a second aperture can be provided in the surface of the coverlet 10 to which is coupled the adaptor 34 in order for the adaptor to be mounted and coupled in fluid communication with the fluid pathway. The adaptor 34 is removably coupled, and this can be by any of the means by which the first pump 36 is removably coupled to the coverlet 10. However, in other embodiments, the adaptor can be integral with the coverlet.

In one embodiment, the first pump 32 includes a battery coupler coupled to a battery and is battery powered, meaning that in order for the pump 32 to be operated, it is not necessary to connect it to an external power supply. However, in other embodiments, the first pump 32 can additionally or alternatively include an AC power coupler for powering by an external power supply. In some embodiments, the first pump can be selectively operated by battery or external AC power to enable a selection of therapy and/or to enable optional application away from an external power supply.

Figure 5:
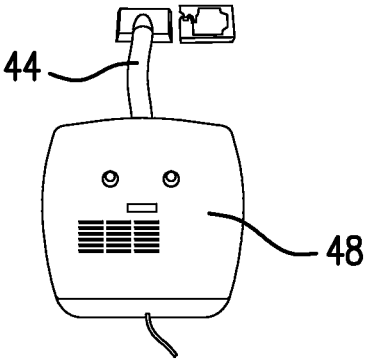
FIG. 5 is a view showing the adaptor of FIG. 4 with an external pump attached.
Figure 6:
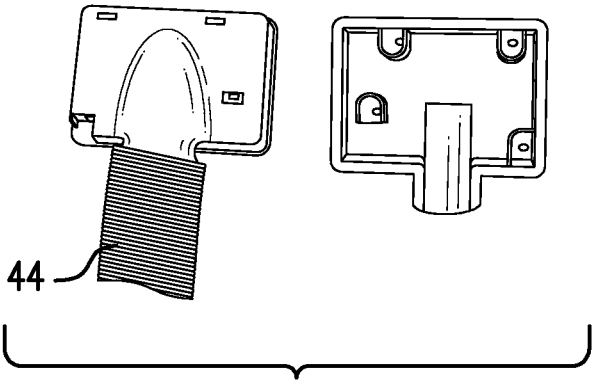
FIG. 6 is a close-up of FIG. 5.

The adaptor 34 includes an adaptor housing 38 which is coupled over the second aperture. An adaptor pathway or conduit 40 leads from the second aperture to a port 42. The port 42 can be coupled to a hose 44 for example as shown in FIGS. 5 and 6. The hose 44 can lead to an external air supply 48 as shown in FIG. 5 in order to couple the fluid pathway of the coverlet 10 to an external air supply 48.

Figure 3C:
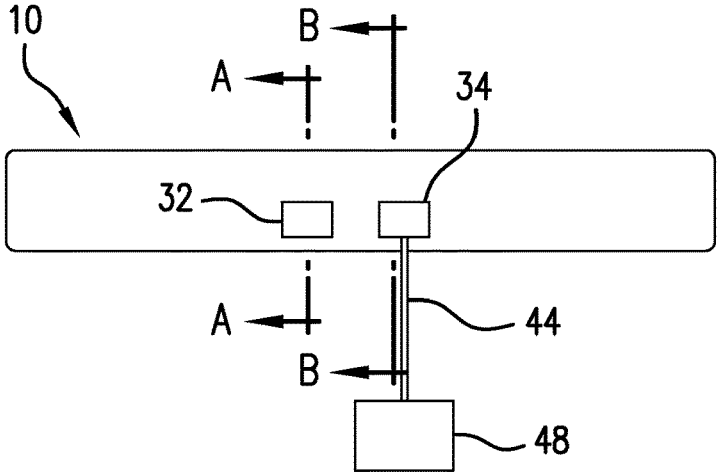
FIG. 3C is an end view of a coverlet according to an embodiment of the present disclosure.
Figure 3D:
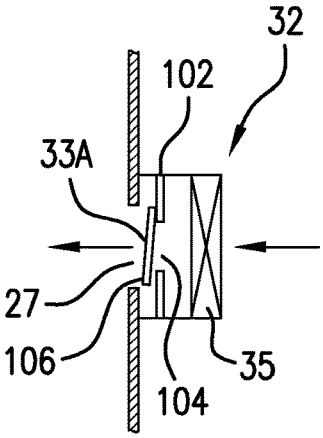
FIGS. 3D-3E are cross-sectional views of pumps for embodiments of the present disclosure.

In some embodiments, a valve is provided in the first fluid pump 32 to prevent air being drawn into or lost from the fluid pathway when the adaptor 34 is being used with an external air supply 48 and the first fluid pump 32 is not being used. As shown in FIGS. 3D and E a valve 33*a*, 33*b* can be placed between the first aperture 27 and a pumping element 35.

Although many different types of valve can be used, in this embodiment, the valve 33*a*, 33*b* includes an annulus 102 providing an annular opening 104 which is selectively closed by a valve flap 106. The valve flap 106 includes at least one part fixed to the annulus 102 and one edge which is free. The valve can open by the free edge being pushed away from the annulus 102 by air flow.

FIG. 3*d* shows a valve 33*a* for the first pump 32 to be used with positive pressure. In this embodiment, the valve 33*a* is configured so that the free edge of the valve flap 106 moves away from the pumping element 35 when the pumping element 35 is operated, but is pressed against the annulus and closed by air attempting to leave the fluid pathway through the first aperture 27.

Figure 3E:
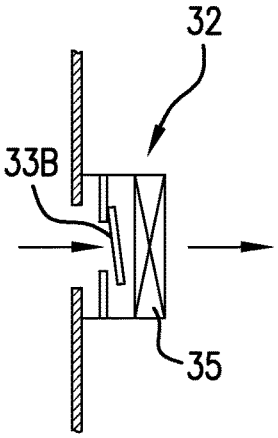

FIG. 3*e* shows a first fluid pump 32 to be used with negative pressure, in which the valve flap 106 is configured so that the free edge moves towards the pumping element 35 when the pumping element 35 is operated to draw air out of the fluid pathway but is configured to be closed by air attempting to enter the fluid pathway through the first aperture 27.

As can be seen in FIG. 3*d*, the valve flap 106 is arranged on a side of the annulus 102 opposite the pumping element 35, and in FIG. 3*e* the valve flap 106 is arranged on a side of the annulus 102 closer to the pump element 35.

Figure 3F:
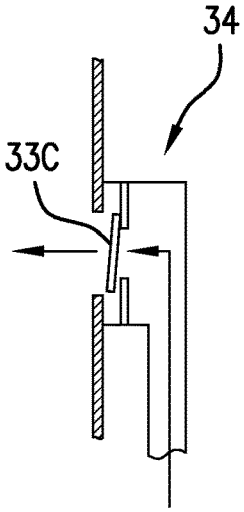
FIGS. 3F-3G are cross-sectional views of adaptors for embodiments of the present disclosure.
Figure 3G:
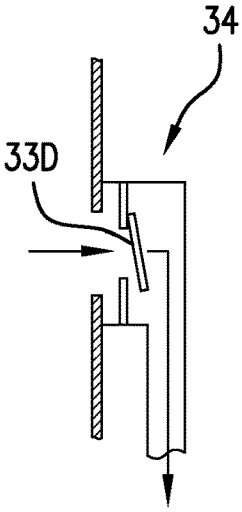
Figure 4:
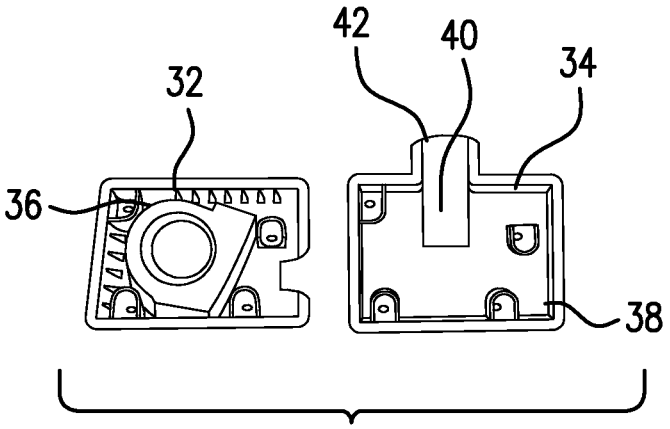
FIG. 4 is a view of a pump and adaptor for embodiments of the present disclosure.

As can be seen in FIGS. 3*f* and 3*g*, a valve 33*c*, 33*d* can be provided in the adaptor pathway to prevent air being drawn into or lost from the fluid pathway when the first fluid pump 32 is operating or when there is no pump coupled to the adaptor 34. The valves 33*c*, 33*d* are configured to operate in a corresponding manner to the valves 33*a*, 33*b*. The valve 33*c* in FIG. 3*f* is arranged in a corresponding manner to FIG. 33*a* in FIG. 3*d* for embodiments which are designed to use positive pressure, and the valve 33*d* in FIG. 3*g* is configured to operate as per the valve 33*b* in FIG. 3*e* in which negative pressure is designed to be used.

In this embodiment, no removal or replacement of pumps is required. Power is selectively supplied to the pump desired to be used for example using operating switches on the pumps and/or power supplies. As described above, this embodiment uses valves to prevent air flow through the pump not in use. FIG. 3C shows both pumps set up for operation with coverlet 10. FIG. 3D shows pump 32 powered in the pressure mode with valve 33A opened to allow flow from pump 32 to coverlet 10. Valve 33A will close if pump 32 is not powered and external air supply 48 is powered. FIG. 3E shows pump 32 powered in the suction mode with valve 33B open to allow flow of air from coverlet to pump 32. Valve 33B will close if pump 32 is not powered and external air supply is powered.

When both pump 32 and adaptor 34 are installed on coverlet 10 for use in the pressure mode, pump 32 incorporates a one-way valve 33A as in FIG. 3D and adaptor 34 incorporates a one-way valve 33C as in FIG. 3F to prevent back-flow through the air supply not in use.

When pump 32 and adaptor 34 are installed in the suction air flow mode, pump 32 incorporates a one-way valve 33B as in FIG. 3E and adaptor 34 incorporates a one-way valve as in FIG. 3G to prevent flow through the air supply not in use. In another embodiment, if either negative or positive pressure air flow is contemplated, each pump supply system 18 can be equipped with a normally closed solenoid valve that is powered open by the same power that drives the pump. Each air supply 18 will be in air communication with coverlet 10 only when it is powered and its valve is powered open. Otherwise valves are normally closed at all other times. This ensures no back-flow through unpowered air systems present in the assembly.

Although the embodiments described above involve a first pump being coupled over a first aperture and adaptor being coupled over a second aperture, in other embodiments, instead of having a second aperture, the first aperture can be provided with a mounting element, and each of the first pump 32 and the adaptor 34 can be provided with a coupling element.

Each of the coupling elements is configured to be able to co-operate with the mounting element in order selectively and removably to mount either the first pump 32 or the adaptor 34 over the first aperture 27. In this way, it is not necessary for the first pump 32 to be constantly attached to the coverlet 10. Furthermore, it is not necessary for the adaptor or the first pump 32 to include valves.

Figure 7:
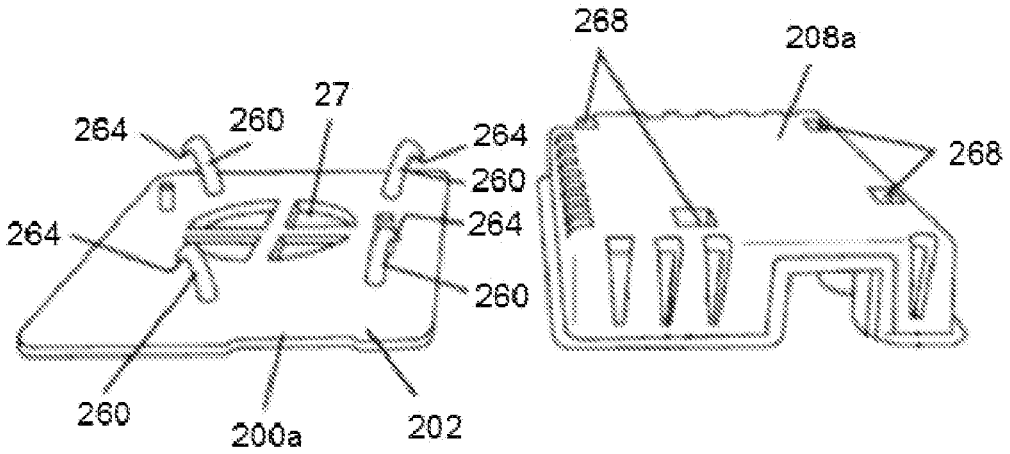
FIG. 7 is a view showing an example of selective coupling with a mounting element and housing in an embodiment of the present disclosure.
Figure 8:
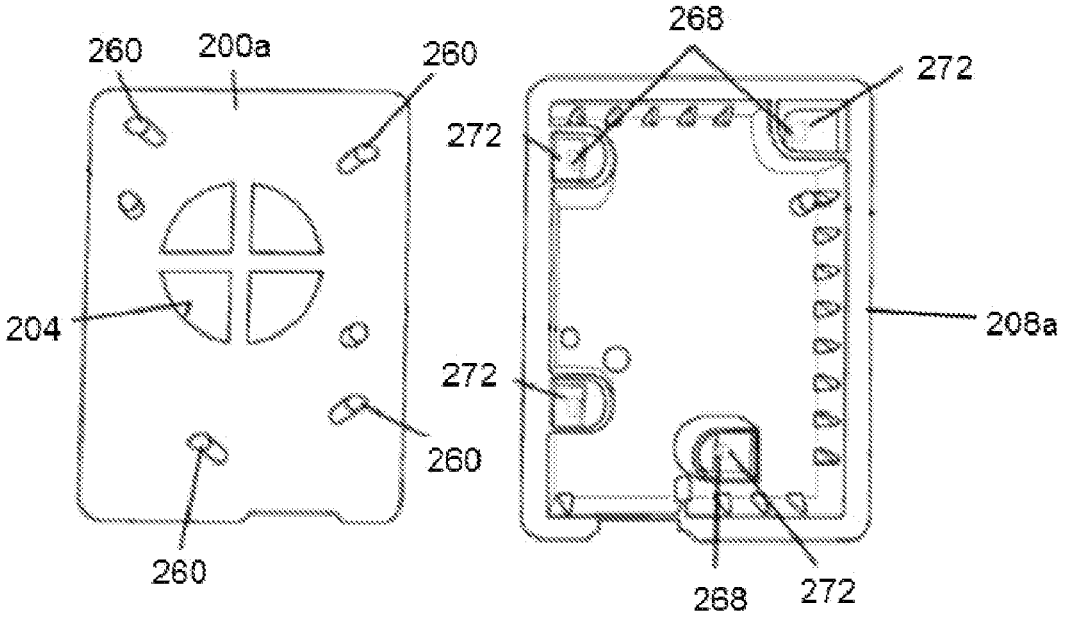
FIG. 8 is a top view of the mounting element of FIG. 7 alongside a bottom view of the housing of FIG. 7.
Figure 9:
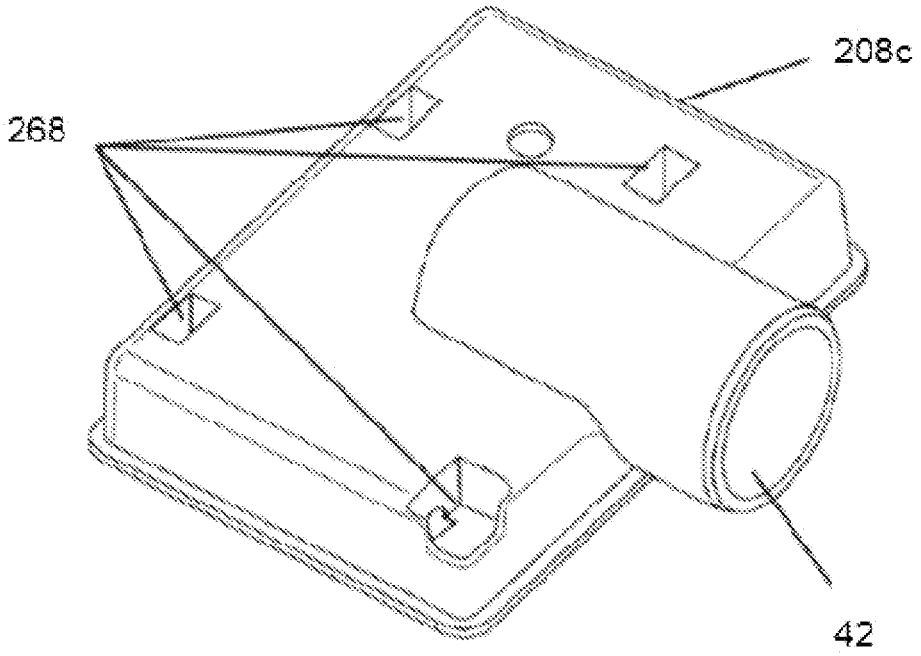
FIG. 9 is a view of a housing for an adaptor according to an embodiment of the present disclosure.

One example of such selective coupling is shown in FIGS. 7 to 9. The first pump can have a housing 208*a* as shown in FIGS. 7 and 8 and the first aperture can have a mounting element 200*a* as also shown in FIG. 7. The housing 208*a* can have a coupling element in the form of tabs 272 and optionally holes 268 in which the tabs 272 are located. The mounting element includes projections 260 with barbs 264 arranged so that when the housing 208*a* is placed on the mounting element 200*a*, the protrusions 260 extend into the holes 268 and the barbs cooperate with and are caught by the tabs 272 in order to couple the housing to the mounting element. A base 202 of the mounting element 200*a* can be provided on an external surface of the coverlet, or can be provided on an internal surface of the coverlet, for example an internal surface of the first layer 30, with the projections protruding through the coverlet surface.

To remove the first pump housing 208*a*, a release tool is used with extensions that are pressed simultaneously into holes 268 to release all barbs simultaneously for disengaging.

As shown in FIG. 9, the adaptor can have a housing 208*c* with a corresponding coupling element, that is in this example with holes 268 and tabs 272 corresponding to the holes 268 and tabs 272 on the housing 208*a* of the first pump.

This makes housings 208*a* and 208*c* interchangeable on mounting element 200*a*.

Further details of the coupling arrangements of FIGS. 7 to 9 are described in U.S. Pat. No. 8,918,930, the disclosure of which is incorporated herein by reference in its entirety, in particular paragraphs 59 and 60 and FIGS. 6A, 6B, 6C, 6D, 8A and 8B thereof.

In other embodiments, different mounting elements and coupling elements can be used. In one embodiment, screws or other suitable retaining means can be used to remove and interchange first pump and adapter.

A desired one of the first or second pump can be coupled to the coverlet as appropriate by mounting the first fluid pump on the mounting element or by mounting the adaptor on the mounting element and coupling it to the second pump.

The coverlet 10 includes a coverlet connector or an attachment element 50 for attaching the coverlet 10 to a chair 12. In this embodiment, the attachment element 50 is a loop of material at a first end 52 of the coverlet 10. Looping material 50 is a strip of material which is attached at both ends to the first end 52 of the coverlet 10 and able to go over a head rest 54 of a chair 12. However, the attachment element 50 may in other embodiments be attached to the coverlet at other points. Furthermore, there can be more than one attachment element. For example, in one embodiment, the coverlet connector or attachment element 50 may be configured as one or a plurality of tethers and/or straps and/or ties extending from a head and/or foot and/or along a length of coverlet 10. The coverlet connector may have fasteners, couplers, adhesives, hook and loop materials, or snaps for detachably securing the coverlet connector to itself to form a loop structure or to other surfaces or structures of a bed, chair or other support in order to removably secure the coverlet to the support surface.

The coverlet 10 described above is a versatile and portable coverlet which is not restricted to use on mattresses for patients lying in a supine position.

As described above, many patients need to be seated in a chair during treatment, and some patients may wish to have the advantages of a moisture control coverlet when they are not directly receiving treatment. As can be seen from FIG. 1, the coverlet 10 described above can be easily placed over a chair to allow the moisture control coverlet to continue to control moisture removal from a patient while they are seated in a chair.

Furthermore, the pump system 18 enables the coverlet 10 to be operated by a small battery powered pump which in some embodiments is affixed to the coverlet and is in any event easily transported with the coverlet 10. This eliminates the need to carry around a bulky pump and attachment apparatus. It also enables the coverlet to be operated where there is not a convenient power supply.

Furthermore, the use of an additional separate adaptor means that when the patient reaches a place where they require more intensive moisture removal, or where they are likely to be positioned for an extended period of time, they can couple the coverlet 10 to a more powerful external pump to enable it to be more effective.

Figure 2:
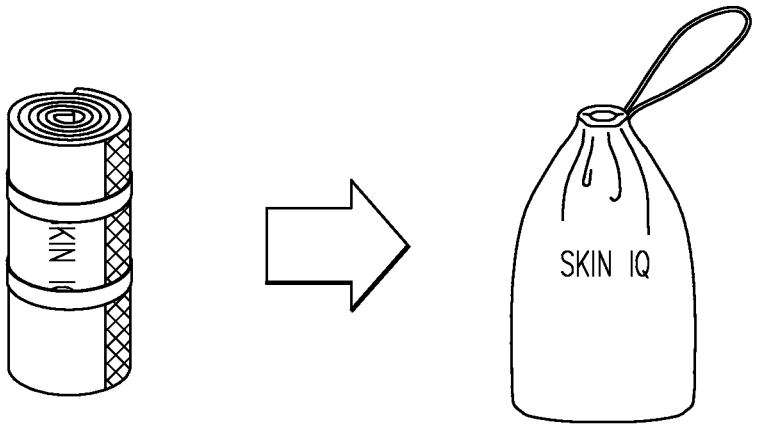
FIG. 2 is a schematic diagram of the coverlet of FIG. 1 being packaged for transport.

The coverlet can easily be rolled-up like a sleeping bag and placed into a transporting bag, for example as shown in FIG. 2. Advantageously, the coverlet connector or attachment element 50 can be used as shown in FIG. 2 to tie the coverlet in a rolled position such as shown in FIG. 2. For this purpose, one end of the attachment element 50 can be detached from the coverlet 10 and used as a tie.

The adaptor 34 and the first fluid pump 32 can be disposable, optionally together with the rest of the coverlet 10, meaning that after its intended use, the entirety of the coverlet can be disposed of.

In some embodiments, the adaptor and the first fluid pump can be removed from the coverlet 10 to enable them to be cleaned. Removing the first fluid pump and the adaptor 34 from the coverlet 10 also means that the coverlet, with the pump system 18 removed, can be laundered.

However, in other embodiments, the first pump 32 can be provided within the coverlet 10.

In embodiments which include a first pump coupled over a first aperture and an adaptor coupled over a second aperture, the first pump and adaptor can be removable from the coverlet. The first and second apertures can provide mounting points. For example, they can each be provided with a mounting element as described above and the first pump and the adaptor can be provided with coupling elements as described above. In some embodiments, the mounting elements are the same to allow either the first pump or the adaptor to be mounted on either aperture. In other embodiments, the mounting elements and coupling elements are configured so that the first pump can only be mounted on the first aperture and the adaptor can only be mounted on the second aperture.

The coverlet does not need exactly three layers. Other arrangements are possible. For example, possible configurations of the fluid pathway are provided in U.S. Pat. Nos. 8,372,182 and 8,918,930, the entirety of which are incorporated herein by reference. Details and modifications described therein are applicable to the coverlet 10 described herein. However, other modifications may also be made to the configuration of the coverlet, provided the coverlet includes a fluid pathway through which the pump system 18 can pump moisture removal fluid to remove moisture from the vicinity of a patient adjacent to the coverlet.

All optional and preferred features and modifications of the described embodiments and dependent claims are usable in all aspects of the invention(s) taught herein. Furthermore, the individual features of the dependent claims, as well as all optional and preferred features and modifications of the described embodiments are combinable and interchangeable with one another.

The foregoing description has been presented for the purpose of illustration and description only and is not to be construed as limiting the scope of the invention in any way. The scope of the invention is to be determined from the claims appended hereto. While devices, kits, system and methods have been described with reference to certain embodiments within this disclosure, one of ordinary skill in the art will recognize that additions, deletions, substitutions and improvements can be made while remaining within the scope and spirit of the invention as defined by the appended claims.

The invention claimed is:

1. A moisture control coverlet comprising a fluid pathway for moisture removal fluid and a mounting element arranged on an outer surface of the moisture control coverlet, the mounting element comprising a base arranged on and directly contacting the outer surface of the moisture control coverlet and having an opening therethrough in fluid communication with the fluid pathway, wherein for pumping moisture removal fluid into or out of the fluid pathway, the moisture control coverlet is:

selectively configurable to use a fluid pump mounted on the mounting element to pump moisture removal fluid into or out of the fluid pathway; and selectively configurable to use an adaptor mounted on the moisture control coverlet and coupled to a remote fluid pump to pump moisture removal fluid into or out of the fluid pathway, the adaptor coupled to the fluid pathway, and wherein the base of the mounting element comprises a plurality of projections extending outwardly away from the outer surface of the moisture control coverlet and arranged about the opening and configured to releasably engage one or more tabs in one or more recesses in a housing of the fluid pump arranged on the outer surface of the moisture control coverlet.

2. A moisture control coverlet comprising:

a fluid pathway, wherein moisture removal fluid is pumped into or out of the fluid pathway for removing moisture from a surface of the moisture control coverlet; and a mounting element in fluid communication with the fluid pathway, the mounting element comprising a base arranged on and directly contacting an outer surface of the moisture control coverlet and comprising one or more protrusions extending outwardly away from an outer surface of the moisture control coverlet and, the mounting element selectively configured to be mounted to a fluid pump housing by the one or more protrusions and selectively configured to be mounted to an adaptor configured to be coupled to a remotely positioned fluid pump to pump moisture removal fluid into or out of the fluid pathway.

3. The moisture control coverlet according to claim 2, wherein the adaptor comprises one or more recesses for removable mounting to the one or more protrusions of the moisture control coverlet, wherein the adaptor is in fluid communication with the fluid pathway when mounted to the mounting element.

4. A moisture control coverlet comprising:

a fluid pathway, wherein moisture removal fluid is pumped into or out of the fluid pathway for removing moisture from a surface of the moisture control coverlet;

a mounting element arranged on an outer surface of the moisture control coverlet and configured to removably couple with a fluid pump arranged on the outer surface of the moisture control coverlet, the mounting element comprising a base arranged on and directly contacting the outer surface of the moisture control coverlet, the base having an opening therethrough in fluid communication with the fluid pathway, the mounting element comprising a plurality of projections extending outwardly away from an outer surface of the moisture control coverlet; and an adaptor removably mounted to the mounting element and in fluid communication with the opening, wherein the adaptor is selectively configurable to be coupled to a remote fluid pump to pump moisture removal fluid into or out of the fluid pathway.

5. The moisture control coverlet according to claim 2, further comprising a fluid pump removably mounted to the moisture control coverlet and in communication with the fluid pathway, the fluid pump housing comprising one or more recesses for mounting to the mounting element.

6. The moisture control coverlet according to claim 4, further comprising a second mounting element arranged on the outer surface of the moisture control coverlet, the second mounting element comprising a second opening in fluid communication with the fluid pathway, wherein the second mounting element is configured to selectively have mounted to it the fluid pump and/or the adaptor.

7. A kit comprising:

the moisture control coverlet according to claim 1;

a fluid pump for mounting onto the moisture control coverlet; and an adaptor for mounting onto the moisture control coverlet and for coupling to a remote fluid pump.

8. The kit according to claim 7, wherein the fluid pump includes a battery coupler for coupling to a battery for battery power.

9. The kit according to claim 7, wherein the fluid pump includes an alternating current coupler for coupling to an alternating current power source for an alternating current power.

10. The kit according to claim 7, wherein the fluid pump or the adaptor are removable from the moisture control coverlet and the moisture control coverlet is launderable.

11. The kit according to claim 7, wherein the fluid pump, the adaptor, or the moisture control coverlet is disposable.

12. The kit according to claim 7, wherein the moisture control coverlet is portable and includes an attachment element for attaching the moisture control coverlet to a chair.

13. The kit according to claim 7, wherein the attachment element includes a fastener, coupler, adhesive, hook or loop material, or snap at an end of the moisture control coverlet for being placed over a headrest of a chair.

14. The moisture control coverlet according to claim 1, wherein the moisture removal fluid is air.

15. The moisture control coverlet according to claim 4, further comprising a vapor permeable cover onto which a patient is adapted to be placed, the cover allowing for vapor to permeate from an external vicinity of the cover through the cover to the fluid pathway.

16. The kit according to claim 7, further comprising:

a second fluid pump for coupling to the adaptor.

17. The kit according to claim 16, wherein the first fluid pump is smaller than the second fluid pump, and wherein the first fluid pump has a lower fluid pumping rate than the second fluid pump.

18. The kit according to claim 16, further comprising a duct for conveying moisture removal fluid between the second fluid pump and the adaptor.

19. The kit according to claim 16, further comprising a switching element for switching between the first pump for pumping moisture removal fluid into or out of the fluid pathway and the second pump for pumping moisture removal fluid into or out of the fluid pathway.

* * * * *